US009844937B1

(12) United States Patent
Komplin

(10) Patent No.: US 9,844,937 B1
(45) Date of Patent: Dec. 19, 2017

(54) METHOD AND APPARATUS FOR MINIMIZING VIA COMPRESSION IN A FLUID EJECTION HEAD

(71) Applicant: FUNAI ELECTRIC CO., LTD., Osaka (JP)

(72) Inventor: Steven R Komplin, Lexington, KY (US)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 15/187,871

(22) Filed: Jun. 21, 2016

(51) Int. Cl.
*B41J 2/14* (2006.01)
*B41J 2/16* (2006.01)

(52) U.S. Cl.
CPC ..... *B41J 2/1408* (2013.01); *B41J 2/14* (2013.01); *B41J 2/1433* (2013.01); *B41J 2/14145* (2013.01); *B41J 2/162* (2013.01); *B41J 2/1623* (2013.01); *B41J 2202/13* (2013.01); *B41J 2202/22* (2013.01)

(58) Field of Classification Search
CPC .... B41J 2/1408; B41J 2/1433; B41J 2/14145; B41J 2/14
See application file for complete search history.

(56) References Cited

U.S. PATENT DOCUMENTS

| | | | | |
|---|---|---|---|---|
| 6,431,693 | B2 | 8/2002 | Eida | |
| 6,502,926 | B2 * | 1/2003 | Cook | B41J 2/1408 347/63 |
| 8,057,022 | B2 | 11/2011 | Umeda | |
| 8,454,148 | B2 | 6/2013 | Nakahata et al. | |
| 2013/0229462 | A1 | 9/2013 | Yamada et al. | |

* cited by examiner

*Primary Examiner* — Geoffrey Mruk

(74) *Attorney, Agent, or Firm* — Luedeka Neely Group, PC

(57) ABSTRACT

A fluid ejection head assembly having improved assembly characteristics and methods of manufacturing a fluid ejection head assembly. The fluid ejection head includes a fluid supply body having at least one fluid supply port in a recessed area therein and a semiconductor chip attached in the recessed area of the fluid supply body adjacent the fluid supply port using a thermal cure adhesive. A compression prevention body having a coefficient of thermal expansion ranging from about 1.0 to less than about 30 microns/meter per ° C. disposed adjacent to the fluid supply port of the fluid supply body and the semiconductor chip.

14 Claims, 10 Drawing Sheets

METHOD AND APPARATUS FOR MINIMIZING VIA COMPRESSION IN A FLUID EJECTION HEAD

TECHNICAL FIELD

The disclosure relates to fluid ejection head structures and in particular to an apparatus and method that are effective for improving the manufacture of fluid ejection devices.

BACKGROUND AND SUMMARY

Fluid ejection heads for fluid ejection devices such as ink jet printers, vapor evaporation devices, and the like continue to be improved as the technology for making the ejection heads continues to advance. New techniques are constantly being developed to provide low cost, highly reliable fluid ejection head structures that can be manufactured in high volume with high yield having relatively low amount of spoilage or ejection head damage.

In order to increase ejection head speed and volume output, larger ejection heads having an increased number of ejection actuators are being developed. However, as the ejection head size and number of ejection actuators increases, manufacturing apparatus and techniques are required to meet increased tolerance demands for such ejection heads. Slight variations in tolerances of parts may have a significant impact on the operation and yield of suitable ejection head products.

The primary components of the fluid ejection head are a substrate or chip containing fluid ejector actuators, and a nozzle plate attached to the chip. The chip is typically made of silicon and contains various passivation layers, conductive metal layers, resistive layers, insulative layers and protective layers deposited on a device surface thereof. For thermal fluid ejection heads, individual heaters are defined in the resistive layers and each heater resistor corresponds to a nozzle hole in the nozzle plate for heating and ejecting fluid from the ejection head toward a target media. Fluid ejection heads may also include bubble pump type ejection head. In a top-shooter type ejection head, nozzle plates are attached to the chips and there are fluid chambers and fluid feed channels for directing fluid to each of the heaters or bubble pumps on the chip either formed in the nozzle plate material or in a separate thick film layer. In a center feed design for a top-shooter type ejection head, fluid is supplied to the channels and chambers from a slot or via that is conventionally formed by chemically etching or grit blasting through the thickness of the chip. The chip containing the nozzle plate is typically bonded to a thermoplastic body using a heat curable adhesive to provide a fluid ejection head structure.

The thermal cure process locks the components together at an elevated temperature. The heater chip has a relatively low CTE (coefficient of thermal expansion) while the plastic body has a relatively high CTE. Heating the components causes each one to expand according to their respective CTEs. As the parts cool and shrink, the higher CTE plastic body shrinks more than the lower CTE silicon heater chip resulting in thermal stresses on the chip. The force-deflection (spring rate) characteristics of the chip and body determine the equilibrium deflection of each part. In many cases the plastic body spring rate dominates the chip spring rate causing via compression and nozzle plate bowing. Nozzle plate bowing may result in poor drop placement or nozzle plate structural failure.

In order to address the issues related to thermal compression of the chip as the chip and plastic body cool, ceramic substrates have been attached to the chip. However, ceramic substrates substantially increase the cost of the ejection head. Silicon bridges in a via area of the chip have also been used, but such silicon bridges result in fluid flow problems in the chip via area.

It is believed that a predominant contributor of chip distortion, cracking, and nozzle plate damage is the coefficient of thermal expansion mismatch between the chip and the thermoplastic body. During manufacturing, when the chip and body go through the adhesive cure cycle, chip distortion is introduced as the components cool. Accordingly, there continues to be a need for improved manufacturing processes and techniques which provide improved ejection head components and structures without product loss due to chip cracking or nozzle plate damage.

With regard to the above, there is provided a fluid ejection head assembly having improved assembly characteristics and methods of manufacturing a fluid ejection head assembly. The fluid ejection head includes a fluid supply body having at least one fluid supply port in a recessed area therein and a semiconductor chip attached in the recessed area of the fluid supply body adjacent the fluid supply port using a thermal cure adhesive. A compression prevention body having a coefficient of thermal expansion ranging from about 1.0 to less than about 30 microns/meter per ° C. disposed adjacent to the fluid supply port of the fluid supply body and the semiconductor chip.

In another embodiment, there is provided a method for reducing compressive forces on a semiconductor chip of a fluid ejection head during a thermal cure process for attaching the semiconductor chip to a fluid supply body. The method includes providing a fluid supply port in a recessed area of the fluid supply body. A compression prevention body is disposed adjacent to the fluid supply port of the fluid supply body and the semiconductor chip, wherein the compression prevention body has a coefficient of thermal expansion ranging from about 1.0 to less than about 30 microns/meter per ° C. A semiconductor chip is attached in the recessed area of the fluid supply body adjacent the fluid supply port using a thermal cure adhesive. The adhesive is thermally cured to fixedly attach the semiconductor chip in the recessed area of the fluid supply body.

In a further embodiment, there is provided a method for reducing via distortion in a semiconductor chip of a fluid ejection head during a thermal cure process for attaching the semiconductor chip to a fluid supply body. The method includes providing a fluid supply port in a recessed area of the fluid supply body. A spherical body is disposed adjacent to the fluid supply port of the fluid supply body and the semiconductor chip, wherein the spherical body has a coefficient of thermal expansion ranging from about 1.0 to less than about 30 microns/meter per ° C. A semiconductor chip is attached in the recessed area of the fluid supply body adjacent the fluid supply port using a thermal cure adhesive. The adhesive is thermally cured to fixedly attach the semiconductor chip in the recessed area of the fluid supply body.

In some embodiments, the compression prevention body has a shape selected from a sphere, a rectangular cube, and a cylinder. In one embodiment, the compression prevention body is a spherical body having a diameter ranging from about 2.0 to about 3.5 millimeters.

In some embodiments, the compression prevention body is made of a material selected from silicon, glass, alumina, stainless steel, or a low CTE polymeric material.

In some embodiments, the compression prevention body has a coefficient of thermal expansion of less than about half a coefficient of thermal expansion of the fluid supply body.

In some embodiments, the fluid ejection head assembly is a micro-fluid ejection head attached to a fluid supply body wherein the fluid ejection head assembly further includes a compression prevention body.

For the purposes of this disclosure, the term "fluid ejection head assembly" means, at least, a combination of cartridge body, compression prevention body, and semiconductor chip.

An advantage of the foregoing structures and methods is that after the adhesive is cured and the parts have cooled, the fluid supply body compresses on the compression prevention body and the chip simultaneously rather than only on the chip. Since the compression prevention body has a spring rate much greater than that of the semiconductor chip in the areas where the chip may be deflected, the deflection of the chip is significantly reduced so that compression of the via in the chip is reduced. Likewise, the compression of the nozzle plate attached to the chip will also be significantly reduced.

BRIEF DESCRIPTION OF THE DRAWINGS

Further advantages of the disclosure may be apparent by reference to the detailed description of preferred embodiments when considered in conjunction with the following drawings, in which like reference numbers denote like elements throughout the several views, wherein features have been exaggerated for ease of understanding and are not intended to be illustrative of relative thicknesses of the features, and wherein.

DETAILED DESCRIPTION OF THE PREFERRED EMBODIMENTS

Figure 1:
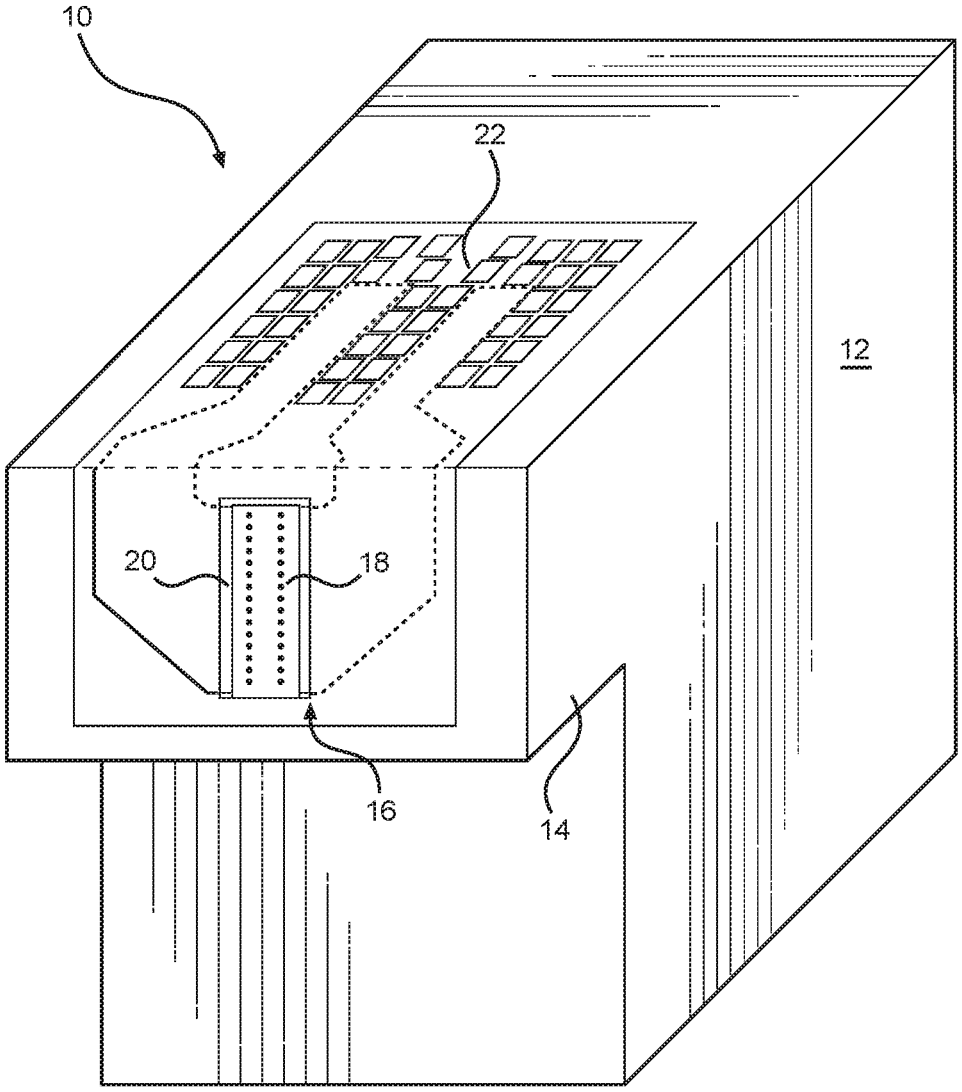
FIG. 1 PRIOR ART
FIG. 1 is a perspective view, not to scale, of prior art fluid supply cartridge containing a fluid ejection head.

A prior art fluid ejection cartridge 10 is illustrated in FIGS. 1 and 2. The fluid ejection cartridge 10 includes a thermoplastic body 12 having a nose section 14 that contains a fluid ejection head 16. The fluid ejection head 16 includes a nozzle plate 18 attached to a semiconductor chip 20. Details of the fluid ejection head 16 components are well known in the art and thus are not reproduced here. A flexible circuit 22 is attached to the semiconductor chip 20 and body 12 to provide power and control of fluid ejection from the ejection head 16.

The body 12 may be made of a polymeric material, such as amorphous thermoplastic polyetherimide materials, glass filled thermoplastic polyethylene terephthalate resin materials, glass-filled polyamide, syndiotactic polystyrene containing glass fiber, polyphenylene ether/polystyrene alloy resins, and polyamide/polyphenylene ether alloy resins. A particularly suitable material for making the body 10 is glass-filled polyphenylene ether/polystyrene alloy resins and polyamide/polyphenylene ether alloy resins. A body 12 made from the foregoing polyphenylene ether resins has a coefficient of thermal expansion (CTE) ranging from about 30 to 75 microns/meter per ° C. as determined by ASTM E-831. By contrast, the substrate 12 may have a CTE of about 2 to about 3 microns/meter per ° C. as determined by ASTM C-372.

Figure 2B:
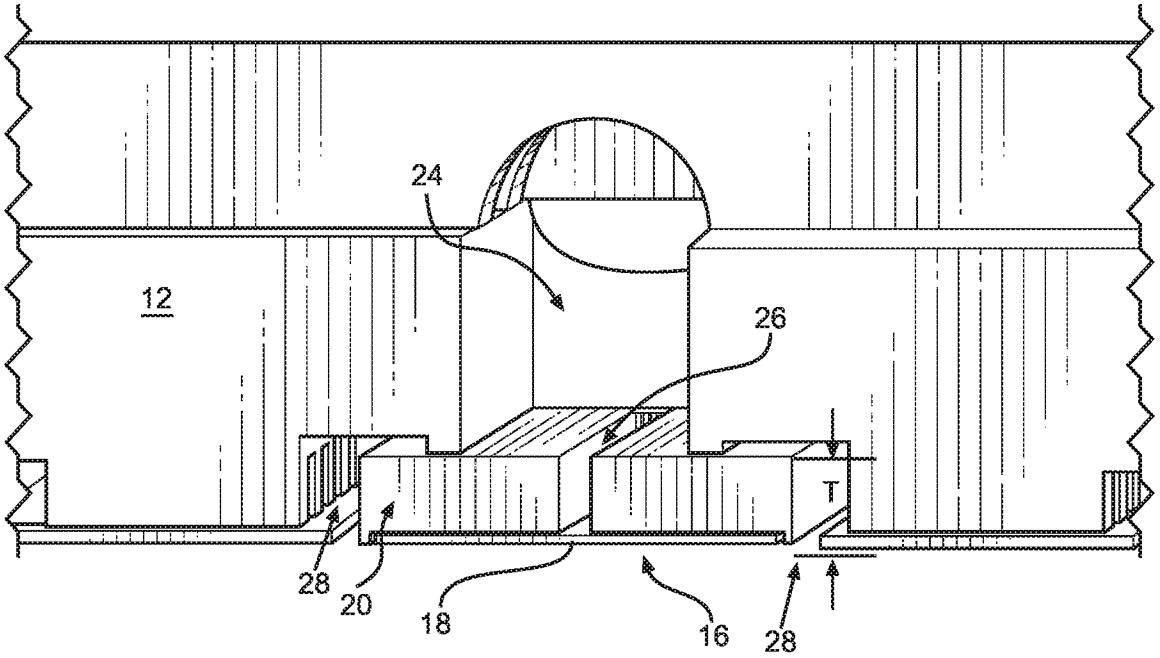
FIG. 2B PRIOR ART
FIG. 2B is a partial cross-sectional view, not to scale, of the nose section of FIG. 2A showing a fluid supply via in the cartridge body and fluid via in the semiconductor chip.
Figure 2A:
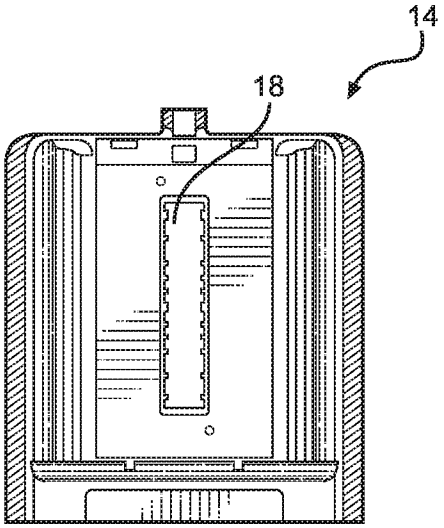
FIG. 2A PRIOR ART
FIG. 2A is a bottom view, not to scale, of a nose section of the prior art fluid supply cartridge of FIG. 1 showing a semiconductor chip and nozzle plate attached thereto.

A bottom plan view of the nose section 14 of the fluid ejection cartridge 10 is shown in FIG. 2A. An enlarged, partial cross sectional view of a fluid flow area of the body 12 is shown in FIG. 2B. The body 12 includes a fluid supply port 24 in the nose section 14 thereof for providing fluid from a fluid reservoir in the body 12 to the ejection head 16.

Figure 2C:
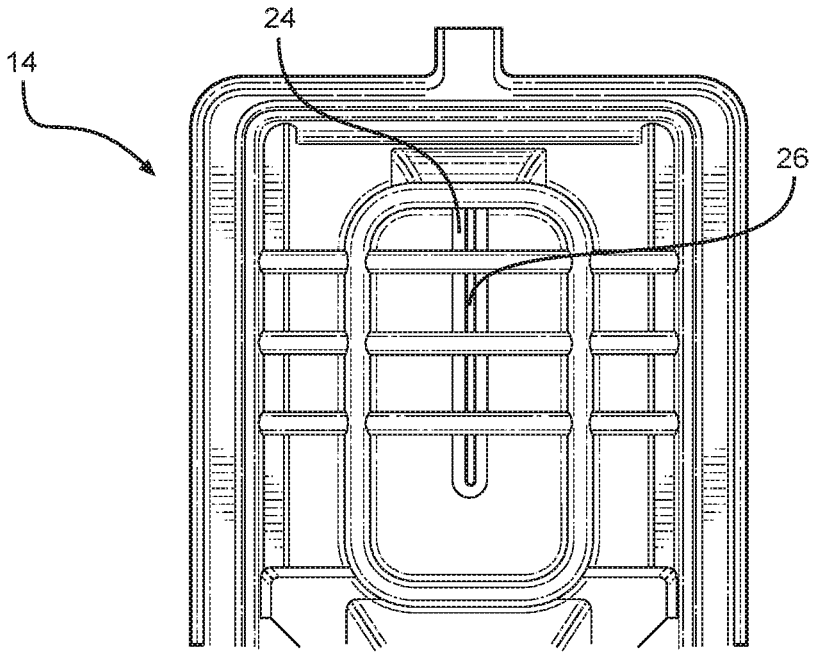
FIG. 2C PRIOR ART
FIG. 2C is a partial top view, not to scale, of the nose section of the prior art fluid supply cartridge of FIG. 2A showing a fluid supply side of the chip.
Figure 2D:
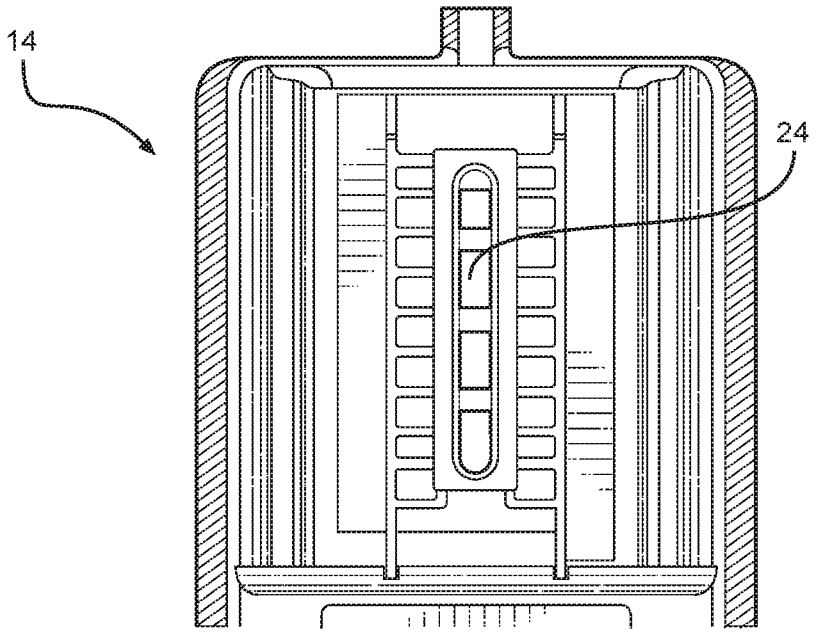
FIG. 2D PRIOR ART
FIG. 2D is a partial lengthwise sectional view, not to scale, of the nose section of the prior art fluid supply cartridge of FIG. 2A with the chip removed.
Figure 2E:
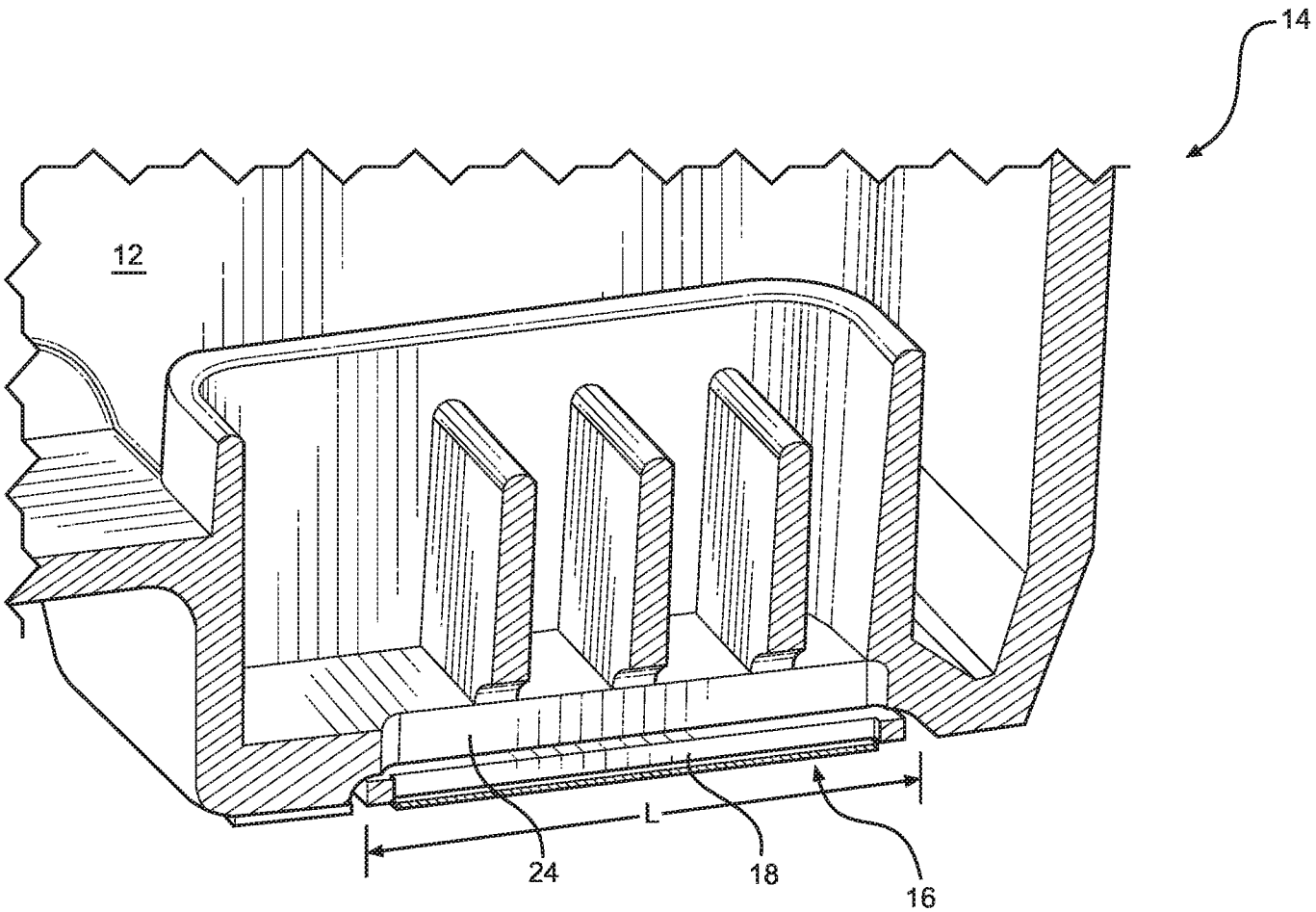
FIG. 2E PRIOR ART
FIG. 2E is a partial bottom view, not to scale, of the nose section of the prior art fluid supply cartridge of FIG. 2A with the semiconductor chip attached to the nose section.

An inside view of the nose section 14 of the ejection fluid cartridge 10 is shown in FIG. 2C and an outside view of the nose section 14 with the ejection head 16 removed is shown in FIG. 2D. A lengthwise, partial cross-section view of the nose section 14 is shown in FIG. 2E. The foregoing views show the amount of body material surrounding the ejection head 16.

As described above, the ejection head 16 includes a nozzle plate 18 attached to a semiconductor chip 20. The semiconductor chip 20 portion of the fluid ejection head 16 may be made of semiconductor or ceramic materials and are fragile compared to the material of the body 12. Accordingly, care must be taken to assure that the semiconductor chips 20 and nozzle plates 18 are not damaged during assembly of the fluid ejection heads 16. The semiconductor chip 20 of the fluid ejection head 16 is relatively small and may have a length (L) of from about 7 to about 100 millimeters by from about 2.5 to about 10 millimeters in width (W) by from about 200 to about 800 microns in thickness (T). The semiconductor chip 20 includes one or more fluid feed vias 26 therein defined by etching through the thickness T of the semiconductor chip 20, for supplying fluid from the body 12 to ejection actuators on a device surface of the semiconductor chip 20.

The ejection head 16 is attached using a thermally curable adhesive (not shown) in a chip pocket area 28 of the nose section 14 of the fluid ejection cartridge 10. The adhesive fixedly attaches the ejection head 16 in the chip pocket area 28 of the nose section 14. The adhesive may be a thermally curable die bond adhesive such as an epoxy adhesive. The thickness of adhesive bond line in the chip pocket 28 between the semiconductor chip 20 and the body 12 may range from about 25 microns to about 150 microns. Heat is typically required to cure the adhesive and fixedly attach the ejection head 16 to the body 12 in the chip pocket 28. The adhesive provides a complete seal between the fluid supply side of the semiconductor chip 20 and the body 12 and is dispensed in the chip pocket 28 prior to attaching the chip 20 in the chip pocket 28. During chip placement, the adhesive will be displaced along the sides of the chip 20 and may protect electrical leads from corrosion from the fluid supply side of the chip 20. An end cap adhesive is dispensed after the chip 20 is in place to complete the encapsulation of the electrical contacts and leads in order to protect the leads from corrosion.

Figure 3A:
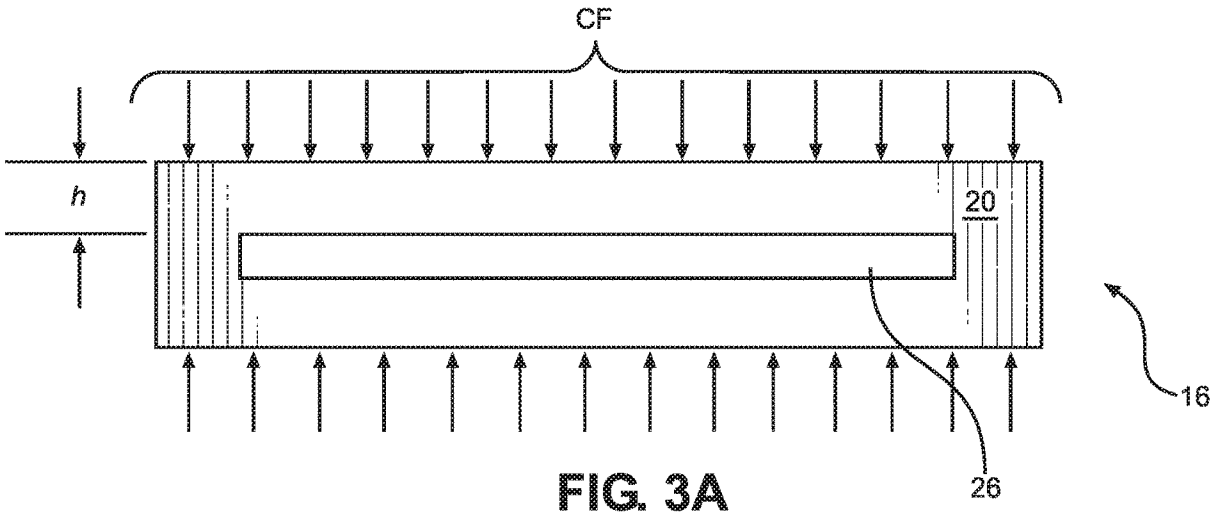
FIG. 3A PRIOR ART
FIG. 3A is a schematic illustration of the total compressive forces on a semiconductor chip attached to the nose section of the prior art fluid supply cartridge of FIG. 2A.

During a procedure for attaching the ejection head 16 to the body 12, there may be a cure cycle temperature change of approximately 60° C. Such a temperature change may cause thermal expansion of the ejection head 16 and the body 12, and the expanded head 16 and body 12 are locked in place by the adhesive. Since the body 12 has an order of magnitude higher thermal expansion coefficient than the ejection head 16, shrinkage in the body 12 during a cooling cycle may be substantially greater than shrinkage of the ejection head 16 causing thermal stresses as the body and head attempt to return to their original unexpanded state. The higher shrinkage of the body 12 causes a compressive force on the semiconductor chip 20 of the ejection head 16 as shown schematically in FIG. 3A. The compressive forces (CF) may cause chip bowing and compression of the fluid feed via 26 along the length of the chip 20. Beam geometry for compressive forces acting on the chip 20 during the cooling cycle is shown schematically in FIG. 3B.

Figure 3B:
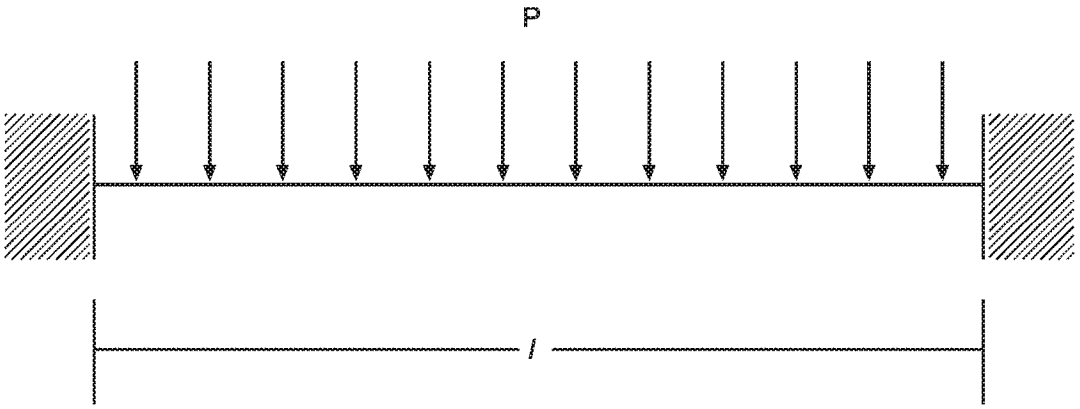
FIG. 3B PRIOR ART
FIG. 3B is a schematic illustration of a total force P over a length l for use in determining a maximum deflection for a via in a semiconductor chip according to a beam equation with fixed ends.

A beam equation for beam geometry having fixed ends and uniform loading as illustrated in FIG. 3B is as follows:

$$\text{Max}y = \frac{-P \times l^3}{384 \times E \times I}$$

wherein y is the maximum single side deflection of the fluid feed via 26 in chip 20, E is a modulus of elasticity for a silicon chip, l is the via length, b the thickness of the silicon chip, h is a width of the area from a side edge of the chip to the via, P is a compressive load over the length l resulting from CTE mismatch, and $I=(b \times h^3)/12$ is the area moment of inertia.

Figure 4A:
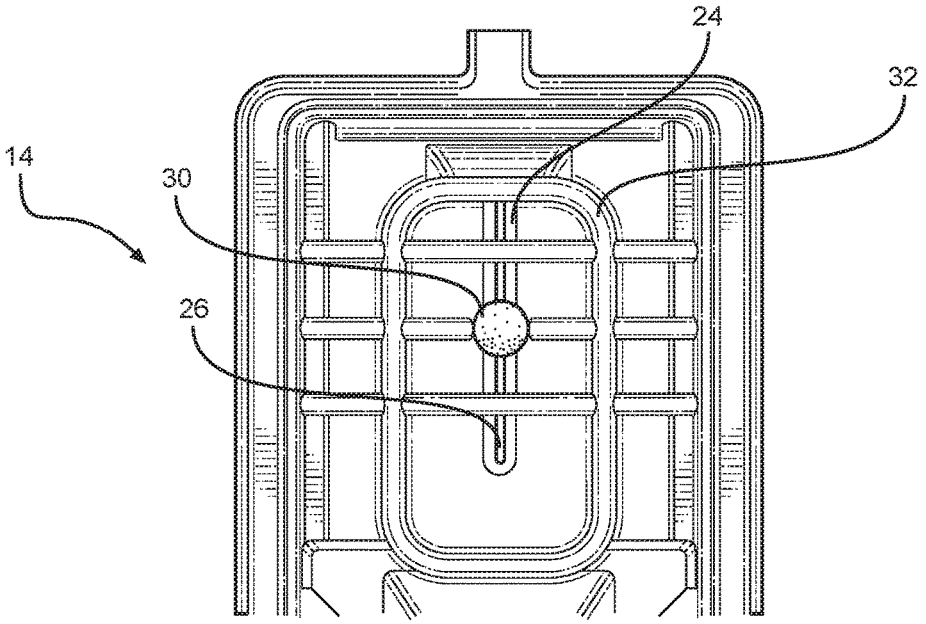
FIG. 4A is a partial top view, not to scale, of the nose section of a fluid supply cartridge according to an embodiment of the disclosure.
Figure 4B:
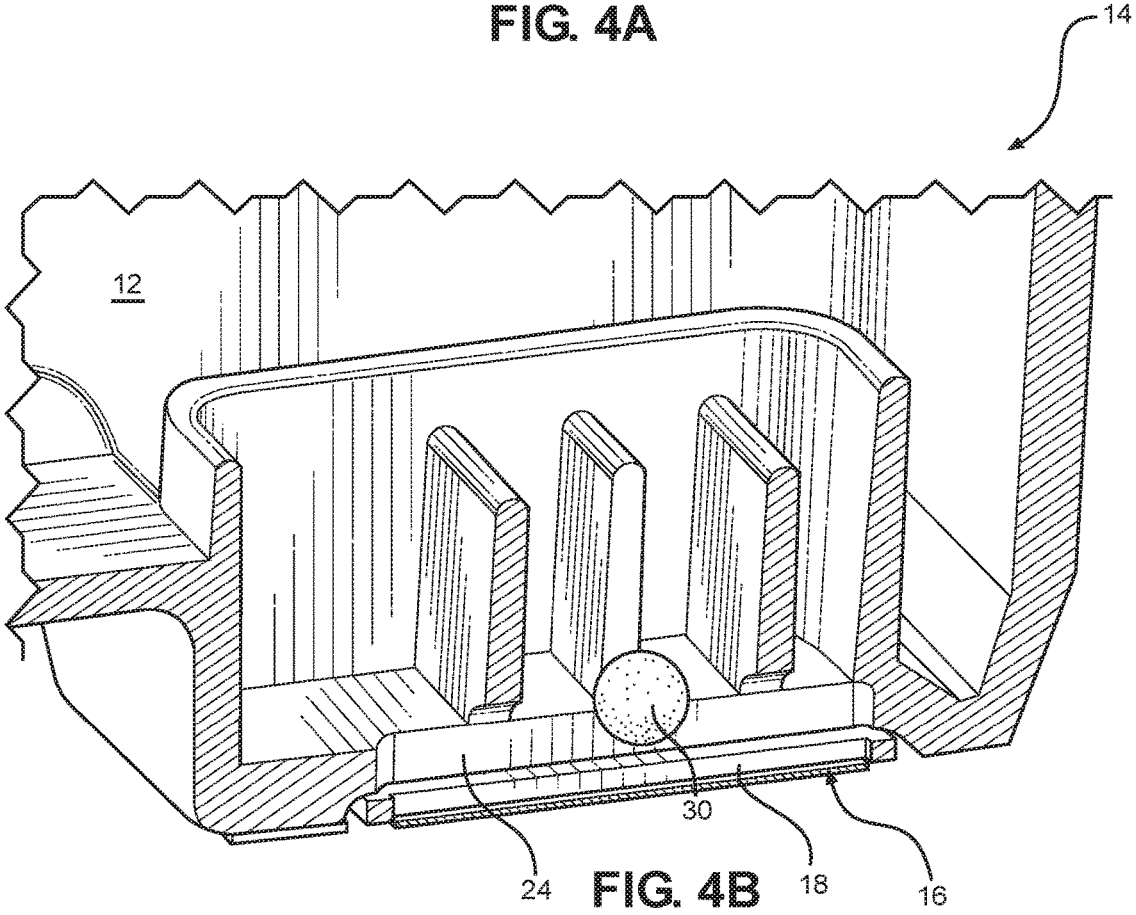
FIG. 4B is a partial lengthwise sectional view, not to scale, of the nose section of the fluid supply cartridge of FIG. 4A.
Figure 4C:
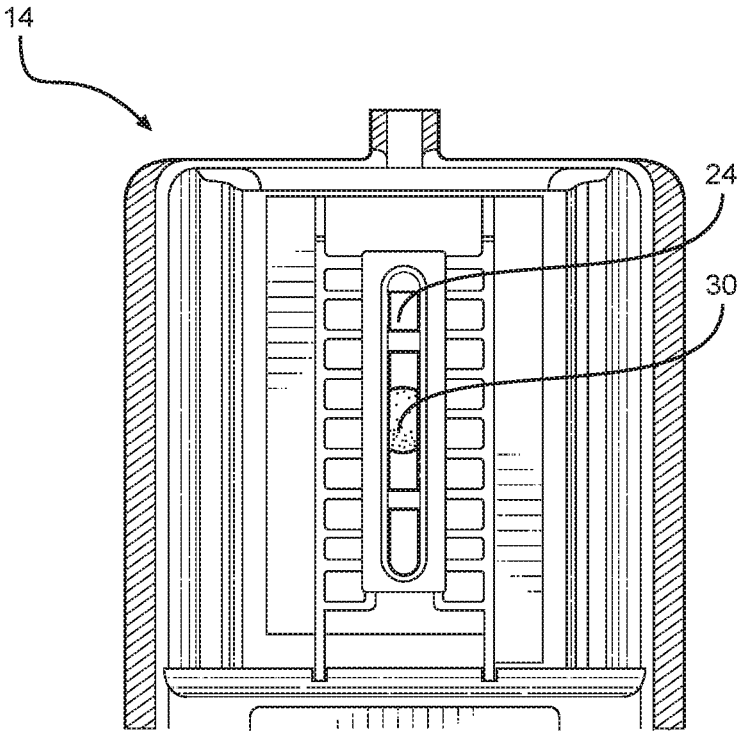
FIG. 4C is a partial bottom view, not to scale, of the nose section of the fluid supply cartridge of FIG. 4A with the semiconductor chip removed.
Figure 4D:
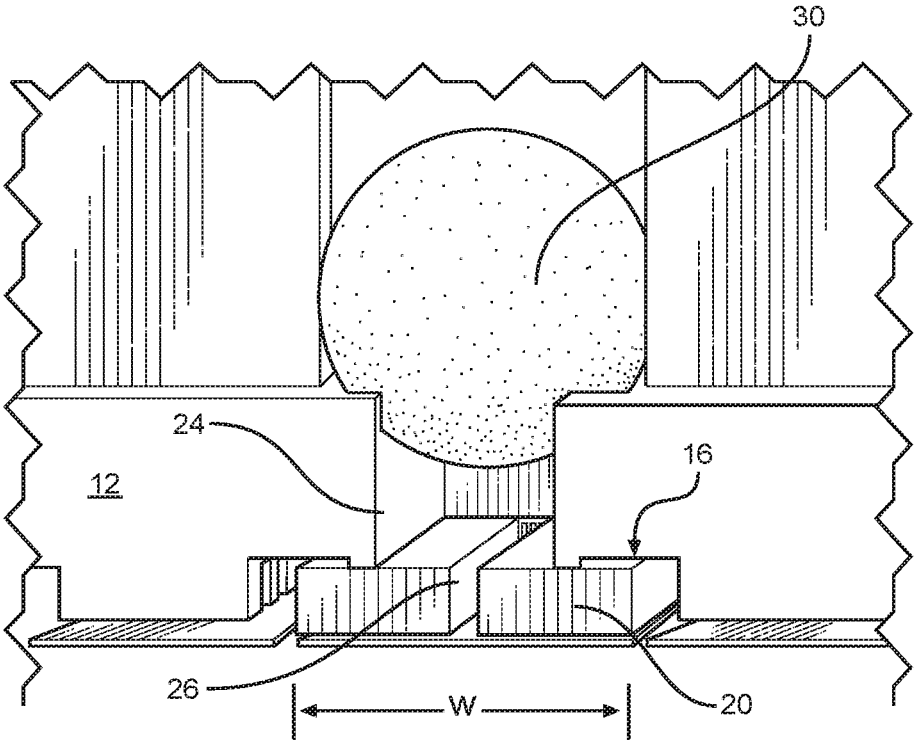
FIG. 4D is a partial cross-sectional view, not to scale, of the nose section of FIG. 4A showing a fluid supply via in the cartridge body and fluid via in the semiconductor chip and a compression prevention body disposed adjacent the fluid supply via of the cartridge body.

In one embodiment of the disclosure, shown in FIGS. 4A to 4D, a compression prevention body 30 in the shape of a sphere is adhesively attached or press fit to the body 12 in the fluid supply port 24 thereof. A partial top view of the cartridge body 12 is shown in FIG. 4A and a partial lengthwise view of a portion of the cartridge body 12 is shown in FIG. 4B showing the placement of the compression prevention body 30 within a filter tower riser 32 of the cartridge body. A partial body view of the cartridge body 12 with the ejection head 16 removed is shown in FIG. 4C showing placement of the compression prevention body 30 therein. As shown in FIG. 4D, the compression prevention body 30 has a size that is effective to reduce compression of the cartridge body 12 on the fluid ejection head 16 as the cartridge body 12 cools. In that regard, the compression prevention body 30 may have a dimension that is substantially the same as an overall width of the semiconductor chip 20. In the case of a spherical compression prevention body 30, the diameter of the body 30 may range from about 1.5 to about 5 millimeters, such as from about 2.5 to about 3.5 millimeters in diameter.

In FIGS. 4A to 4D, the compression prevention body 30 is inserted into the cartridge body 12 from the fluid fed side or inside of the cartridge body 12. In an embodiment illustrated in FIGS. 5A-5D, a compression prevention body 34 that has a diameter smaller than the width (W) of the semiconductor chip 20 may be inserted into the fluid flow path 24 of the cartridge body 12 through the chip pocket 28 before the ejection head 16 is attached to the cartridge body 12.

In other embodiments, the compression prevention body may have a cylindrical shape or a rectangular cubical shape. However, a spherical shape may be the most cost effective since the orientation of the compression prevention body in the cartridge body 12 is unimportant when the compression prevention body has a spherical shape. For example, a cubical compression prevention body may provide a greater area for resisting compressive forces against the chip, however, it may be difficult to properly orient a cubical compression prevention body within the fluid supply port 24.

Regardless of the shape of the compression prevention body 30 or 34, it is highly desirable that the compression prevention body 30 or 34 have a coefficient of thermal expansion similar to a coefficient of thermal expansion of semiconductor chip 20. Accordingly, materials that may be used for the compression prevention body 30 or 34 may be selected from but are not limited to silicon, glass such as borosilicate glass and soda-lime glass, alumina, stainless steel, and a low CTE polymeric material. The coefficient of thermal expansion of the compression prevention body 30 or 34 may range from about 1.0 to less than about 30 microns/meter per ° C., such from about 1.5 to less than about 25 microns/meter per ° C. or from about 2.0 to less than about 18 microns/meter per ° C.

Another important characteristic of the compression prevention body 30 or 34 is that the compression prevention body has a spring rate that is based on the modulus of the material and the geometry of the compression prevention body. The spring rate of the compression prevention body is substantially greater than the spring rate of the semiconductor chip 20 in the areas where the chip 20 may be deflected. While not desiring to be bound by theoretical considerations, it is believed that the spring rate of the compression prevention body must also be much stiffer than spring rate of the cartridge body 12 at the point of placement of the compression prevention body in the cartridge body 12.

Figure 5A:
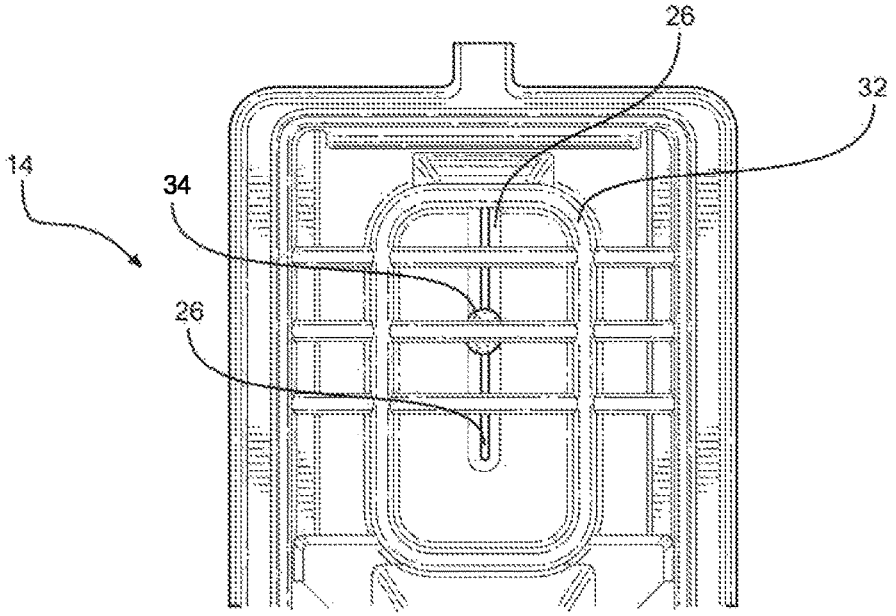
FIG. 5A is a partial top view, not to scale, of the nose section of a fluid supply cartridge according to another embodiment of the disclosure.
Figure 5B:
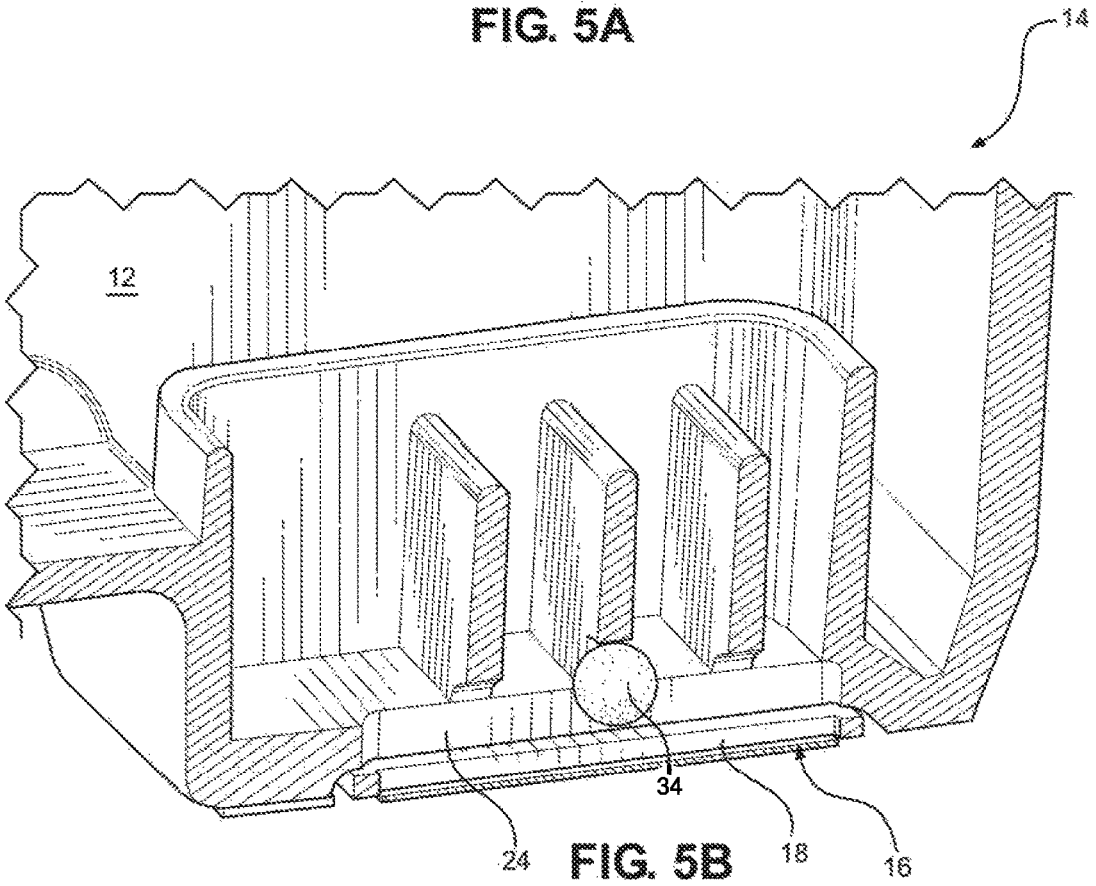
FIG. 5B is a partial lengthwise sectional view, not to scale, of the nose section of the fluid supply cartridge of FIG. 5A.
Figure 5C:
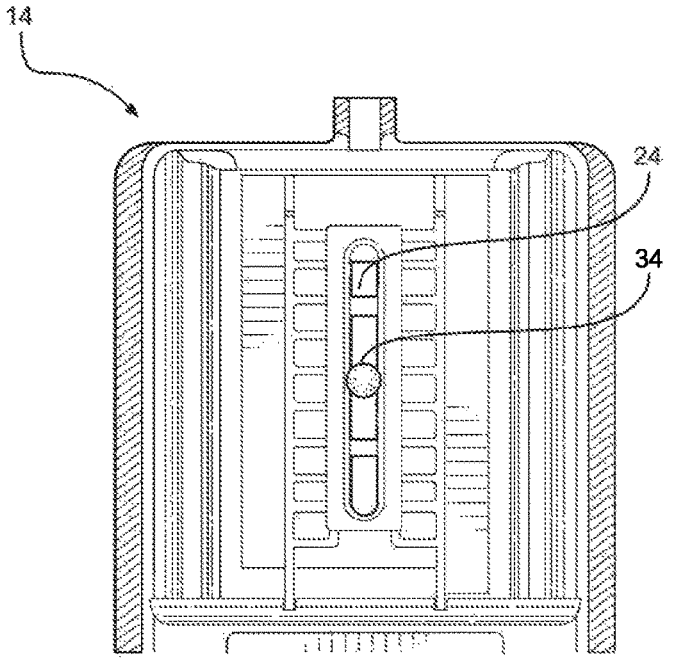
FIG. 5C is a partial bottom view, not to scale, of the nose section of the fluid supply cartridge of FIG. 5A with the semiconductor chip removed.
Figure 5D:
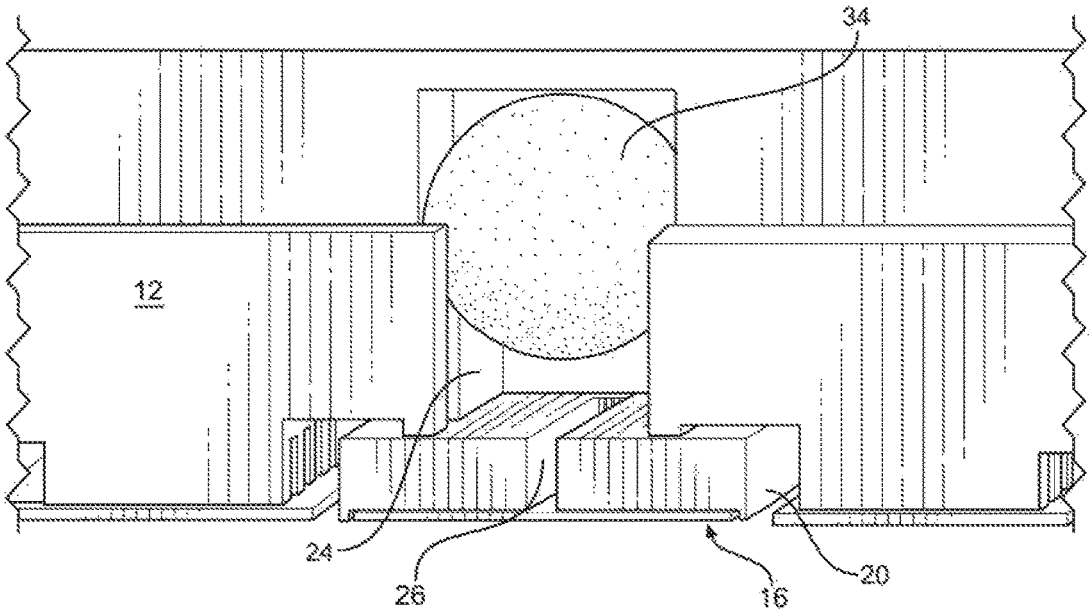
FIG. 5D is a partial cross-sectional view, not to scale, of the nose section of FIG. 5A showing a fluid supply via in the cartridge body and fluid via in the semiconductor chip.

As shown in FIGS. 4D and 5D the ejection head 16 is adhesively attached to the cartridge body 12 and thus any compression of the body 12 during a cooling cycle will tend to compress the fluid feed via 26 in the semiconductor chip 20. However, with the compression prevention body 30 or 34 in place in the fluid supply port 24, the compression of the body 12 on the semiconductor chip 20 is substantially reduced according to the above beam equation. Since the coefficient of thermal expansion of the body 12 is much greater than that of the compression prevention body 30 or 34 and the semiconductor chip 20, the body compresses on both the chip 20 and the compression prevention body 30 or 34. The spring rate of the compression prevention body 30 is much greater than that of the chip 20 providing a modified beam geometry structure of the combination of body 30 or 34 and chip 20 as illustrated in FIG. 6 according to FIG. 3B.

Figure 6:
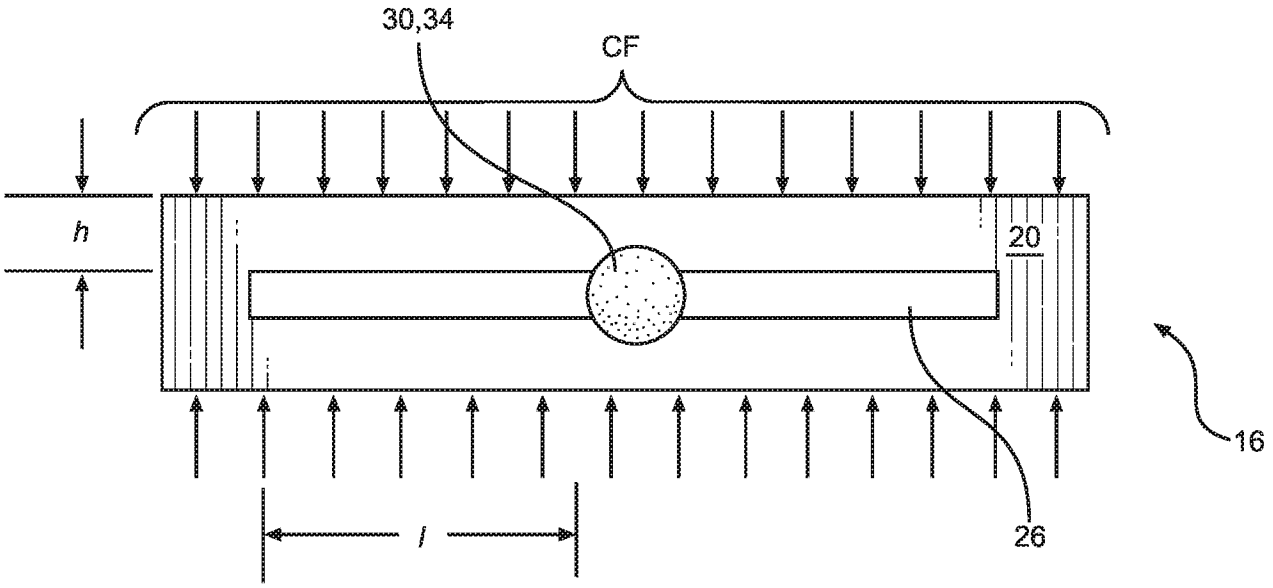
FIG. 6 is a schematic illustration of the compressive forces on a semiconductor chip attached to the nose section of a fluid supply cartridge of when a compression prevention body is used.

As shown in FIG. 6, the beam length l and P are reduced by about 50% thereby reducing the maximum deflection in the fluid feed via 26 by about 1/16th according to the above beam equation assuming the body 30 or 34 and chip 20 have the same coefficient of thermal expansion. However, even if the body 30 or 34 and chip 20 have slightly dissimilar coefficients of thermal expansion, the two parts will pick up the compression load on the fluid feed via 26 in parallel. Thus the compression of the fluid feed via 26 is minimized by use of the compression prevention body 30 or 34. In practice, the deflection reduction of the fluid feed via 26 may be less due to part tolerances, surrounding part geometry, and material properties variations of the parts. Also, the fluid feed via 26 between the compression prevention body 30 or 34 and the end of the chip 20 will have some via compression. Accordingly, more than one compression prevention body 30 or 34 may be used along the length of the fluid feed via 26 to support the compression forces and thereby further reduce compression of the via 26.

While the disclosure has been described in terms of exemplary embodiments, those skilled in the art will recognize that the disclosure can be practiced with modifications in the spirit and scope of the appended claims. The examples are merely illustrative and are not meant to be an exhaustive list of all possible designs, embodiments, applications or modifications of the disclosure.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A fluid ejection head assembly comprising a fluid supply body having at least one fluid supply port in a recessed area therein, a semiconductor chip attached in the recessed area of the fluid supply body adjacent the fluid supply port using a thermal cure adhesive, and a compression prevention body having a coefficient of thermal expansion ranging from about 1.0 to less than about 30 microns/meter per ° C. disposed adjacent to the fluid supply port of the fluid supply body and the semiconductor chip, wherein the compression prevention body has a spherical shape.

2. The fluid ejection head assembly of claim 1, wherein the compression prevention body comprises a material selected from the group consisting of silicon, glass, alumina, stainless steel, and a low CTE polymeric material.

3. The fluid ejection head assembly of claim 1, wherein the compression prevention body comprises a material having a coefficient of thermal expansion of ranging from about 1.5 to less than about 25 microns/meter per ° C.

4. The fluid ejection head assembly of claim 1, wherein the compression prevention body comprises a material having a coefficient of thermal expansion of ranging from about 2 to less than about 18 microns/meter per ° C.

5. The fluid ejection head assembly of claim 1, wherein the compression prevention body has a coefficient of thermal expansion of less than about half a coefficient of thermal expansion of the fluid supply body.

6. The fluid ejection head assembly of claim 1, wherein the compression prevention body has a diameter ranging from about 2.0 to about 3.5 millimeters.

7. A method for reducing compressive forces on a semiconductor chip of a fluid ejection head during a thermal cure process for attaching the semiconductor chip to a fluid supply body comprising:

providing a fluid supply port in a recessed area of the fluid supply body;

disposing a compression prevention body adjacent to the fluid supply port of the fluid supply body and the semiconductor chip, wherein the compression prevention body has a coefficient of thermal expansion ranging from about 1.0 to less than about 30 microns/meter per ° C., and wherein the compression prevention body has a spherical shape;

attaching a semiconductor chip in the recessed area of the fluid supply body adjacent to the fluid supply port using a thermal cure adhesive so that the compression prevention body; and thermally curing the adhesive to fixedly attach the semiconductor chip in the recessed area of the fluid supply body.

8. The method of claim 7, wherein the compression prevention body comprises a material selected from the group consisting of silicon, glass, alumina, stainless steel, and a low CTE polymeric material.

9. The method of claim 7, wherein the compression prevention body comprises a material having a coefficient of thermal expansion ranging from about 1.5 to less than about 25 microns/meter per ° C.

10. The method of claim 7, wherein the compression prevention body comprises a material having a coefficient of thermal expansion of ranging from about 2 to less than about 18 microns/meter per ° C.

11. The method of claim 7, wherein the compression prevention body has a coefficient of thermal expansion of less than about half a coefficient of thermal expansion of the fluid supply body.

12. The method of claim 7, wherein the compression prevention body has a diameter ranging from about 2.0 to about 3.5 millimeters.

13. A method for reducing via distortion in a semiconductor chip of a fluid ejection head during a thermal cure process for attaching the semiconductor chip to a fluid supply body comprising:

providing a fluid supply port in a recessed area of the fluid supply body;

disposing a spherical body adjacent to the fluid supply port of the fluid supply body and the semiconductor chip, wherein the spherical body has a coefficient of thermal expansion ranging from about 1.0 to less than about 30 microns/meter per ° C.;

attaching a semiconductor chip in the recessed area of the fluid supply body adjacent the fluid supply port using a thermal cure adhesive; and thermally curing the adhesive to fixedly attach the semiconductor chip in the recessed area of the fluid supply body.

14. The method of claim 13, wherein the spherical body is selected from a silicon sphere, a glass sphere, an alumina sphere, a stainless steel sphere, and a low CTE polymeric sphere having a diameter ranging from about 2.0 to about 3.5 millimeters.

* * * * *